United States Patent [19]

Franche, IV

[11] 4,176,767

[45] Dec. 4, 1979

[54] DOG FOOD DISPENSER

[76] Inventor: Darius C. Franche, IV, 1401 W. Wabansia Ave., Chicago, Ill. 60622

[21] Appl. No.: 756,785

[22] Filed: Jan. 5, 1977

[51] Int. Cl.[2] ..... B65D 47/26

[52] U.S. Cl. ..... 222/243; 222/408.5; 222/561

[58] Field of Search ..... 222/561, 559, 245, 244, 222/243, 408.5, 345, 346, 349, 352

[56] References Cited

U.S. PATENT DOCUMENTS

| | | | |
|---|---|---|---|
| 1,455,970 | 5/1923 | Resek | 222/243 X |
| 2,099,839 | 11/1937 | Chernoff | 222/243 X |
| 2,507,738 | 5/1950 | Spatz . | |
| 2,746,656 | 5/1956 | Bradshaw . | |
| 3,344,958 | 10/1967 | Kaanehe | 222/559 X |

*Primary Examiner*—John P. Shannon
*Attorney, Agent, or Firm*—James R. Young; John E. Reilly

[57] ABSTRACT

A bin with a hopper bottom is provided for storing and dispensing dog food, including a sliding gate located at the bottom of the hopper for regulating flow of dog food from the bin. The gate includes a solid center section which prohibits flow of dog food from the bin when positioned across the outlet hole at the bottom of the hopper, an opening which allows dog food to flow from the bin when positioned in alignment with the outlet hole, and handle means on its forward end projecting out the front of the dog food dispenser for convenient manual operation. The sliding gate also includes unique forms of agitators connected thereto and protruding upwardly through the outlet hole and into the bin in such a way as to agitate the dog food in the vicinity of the outlet hole as the gate is slidably moved thereby breaking down bridging of the dog food particles and encouraging smooth flow of the dog food from the bin.

17 Claims, 9 Drawing Figures

DOG FOOD DISPENSER

BACKGROUND OF THE INVENTION

The present invention generally concerns storage and dispensing apparatus for particulate matter, and more particularly to a convenient bin for storing dog food with a manually operated dispensing control apparatus for initiating and regulating flow of dog food from the bin into a container from which it can be conveniently consumed by a dog.

Recent years have witnessed the increasing popularity of commercially prepared dog food in pellet or granular form for consumption by dogs. These dog food products have been particularly popular in urban and suburban areas where dogs do not have access to natural foods, and their popularity has been spurred by the rapidly increasing cost of food prepared for human consumption which in the past was frequently fed to dogs by their owners either in the form of table scraps or as prepared by the food processors.

The most convenient and least expensive means of packaging, shipping, and storing these pellet and granular dog food products is in paper or fabric sacks or bags of various sizes capable of holding contents ranging from 5 lbs. to 100 lbs. Dog food purchased in the larger sacks or bags usually costs less per unit of weight than dog food purchased in smaller containers; however, the larger sacks are more difficult to handle and they require a relatively large space for storage which oftentimes is not available in a dog owner's home at a location convenient for access. Consequently, there has been a growing need for a bulk dog food storage and dispensing device which is compact and can be located at a place which is relatively out of the way, yet convenient to use, and from which dog food can be easily and conveniently removed in small quantities without the necessity of manipulating heavy sacks or bags each time the dog is to be fed.

SUMMARY OF THE INVENTION

Accordingly, it is an object of the present invention to provide a novel device for conveniently storing dog food in bulk quantities and dispensing preselected quantities thereof into a container or bowl.

Another object of the present invention is to provide an apparatus for storing and dispensing dog food which includes a storage bin with a hopper bottom, a sliding gate in the hopper bottom for regulating the flow of dog food out of the bin, and agitator means for breaking down bridging or jamming of the pellet or granular particles of dog food to enhance dispensing of the dog food through the hopper bottom without tending to crumble or break up the particles.

Still another object of the present invention is to provide an apparatus for storing and dispensing dog food having a sliding gate with a solid center section which can be slidably moved across the outlet hole at the bottom of the hopper to preclude dog food from flowing from the bin, and an opening which allows dog food to flow from the bin when slidably moved into alignment with the outlet hole at the bottom of the hopper.

A still further object of the present invention is to provide a dog food dispenser with a simplified form of agitator directly connected to the sliding gate and protruding upwardly a limited distance through the opening in the bottom of the hopper into the bin whereby sliding movement of the gate for opening or closing also results in agitation of the dog food within the bin near the vicinity of the outlet opening.

Still another object of the present invention is to provide a dog food dispenser which is simple and inexpensive to manufacture but which provides a gate which is capable of providing an effective seal to prevent dog food from escaping the bin when closed and which is designed to result in a minimum of force necessary to close off the flow of dog food from the bin.

Yet another object of the present invention is to provide a dog food storage and dispensing device which can be wall-mounted at a convenient yet out-of-the-way location which is simple to use and includes a minimum of moving parts.

The dog food storage and dispensing apparatus of the present invention includes a storage bin which can be conveniently fastened on a wall surface for storing bulk dog food and dispensing smaller quantities with relative ease into a dish or bowl from which it can be consumed by a dog. The bin has a hopper or funnel-shaped bottom for concentrating the flow of dog food into a central outlet hole and a sliding gate across the outlet hole. The gate includes a handle portion which extends forwardly through the front of the dispensing device for manual operation of the gate, a solid central section which precludes flow of dog food from the bin when it is aligned with the outlet hole, and an open portion which allows the flow of dog food through the hole when aligned with the outlet hole. The gate also includes an agitator attached thereto and protruding upwardly into the bin through the outlet opening in the hopper for agitating the dog food in the vicinity of the outlet opening simultaneously with the movement of the gate from the closed to the open position. The agitator is activated by sliding movement of the gate and it prevents jamming of pellet or granular particles of dog food to enhance flow of dog food out of the bin through the outlet hole. In one form, a triangular block is affixed to the solid portion of the handle and projects upwardly through the outlet hole a limited distance to cause slight shifting of the dog food particles as the open portion advances into alignment with the outlet hole. Another form of agitator is defined by a flexible screw or auger-shaped element which is caused to advance upwardly through the outlet hole in response to opening movement of the gate.

BRIEF DESCRIPTION OF THE DRAWINGS

Other objects, advantages and capabilities of the present invention will become more apparent as the description proceeds taken in conjunction with the accompanying drawings, in which.

DETAILED DESCRIPTION OF THE PREFERRED EMBODIMENT

Figure 1:
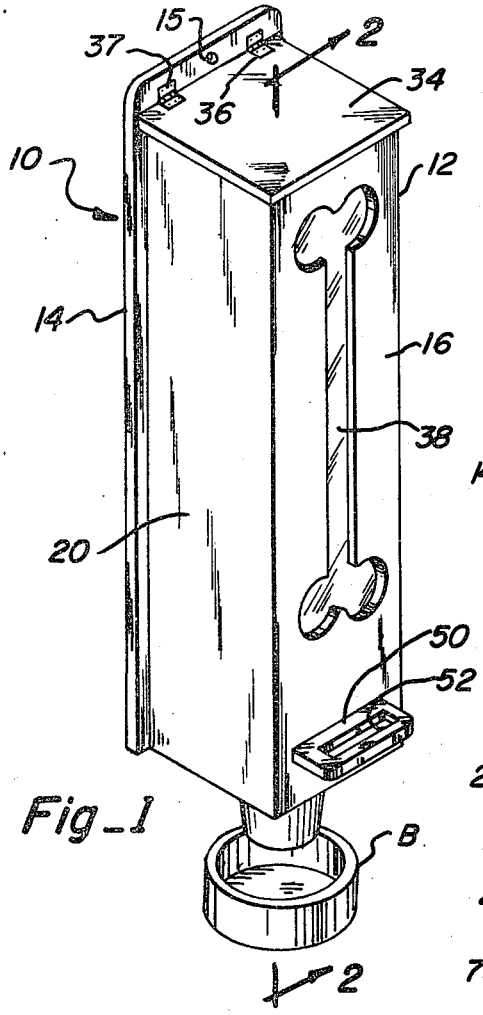
FIG. 1 is an isometric view of the dog food dispenser.
Figure 2:
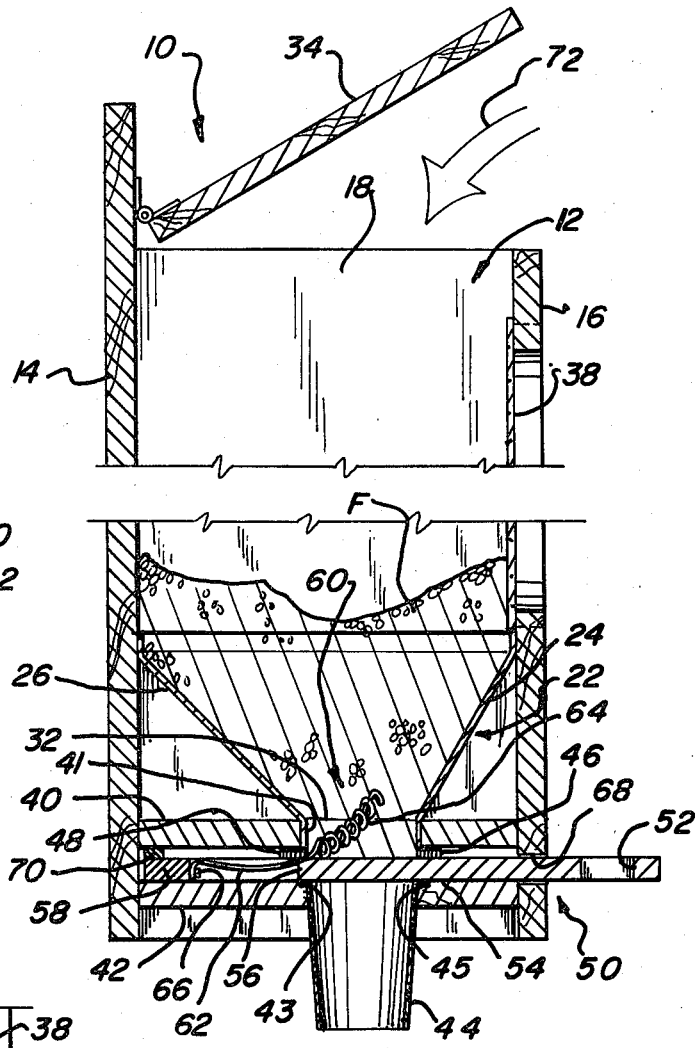
FIG. 2 is a cross-sectional view of the dog food dispenser taken along lines 2—2 in FIG 1, showing the sliding gate in closed position.

A dog food dispenser 10 in accordance with the present invention is shown in FIG. 1 with a bowl B in position thereunder for receiving a portion of dog food F. The dog food dispenser 10 includes a bin 12 enclosed by a rear panel 14, front panel 16, and side panels 18, 20. The rear panel 14 is shown slightly wider than the bin 12 and includes means such as a hole 15 for hanging the dispenser on a wall. A cover 34 is pivotally attached to the rear panel 14 by hinges 36, 37 for enclosing the upper opening of the bin 12. As shown in FIGS. 1 and 2, the cover 34 is somewhat larger in dimension than the upper opening of the bin 12 such that the cover in closed position rests on the upper ends of the front panel 16 and side panels 18, 20.

The bin 12 also has a hopper or funnel-shaped bottom 22 with an outlet opening 32 therein for concentrating the flow of dog food into a central location of smaller cross-sectional area for filling a bowl B. The front wall 24 and rear wall 26 of the hopper 22 are illustrated in FIGS. 2 and 3.

A sliding gate 50 is provided at the outlet opening 32 to regulate the flow of dog food F from the bin as desired. The sliding gate 50 has a solid center section 54, an opening 56 in its rearward portion between center section 54 and rear end section 58, and a handle 52 for manually operating the gate at its forward portion. The gate 50 is slidably mounted in guide means comprised of an upper plate 40 and a lower plate 42 mounted in spaced-apart, parallel relation to each other between the rear panel 14 and front panel 16 at the bottom of the hopper, as best seen in FIGS. 2 and 3. The upper plate 40 has a centrally located hole 41 therein to accommodate the outlet opening 32 of the hopper 22, and the lower plate 42 has a centrally located hole 43 therein in axial alignment with the hole 41 in upper plate 40 and the outlet opening 32 in hopper 22 to accommodate the flow of dog food F out the bottom of the bin 12 when the gate 50 is in open position.

Figure 3:
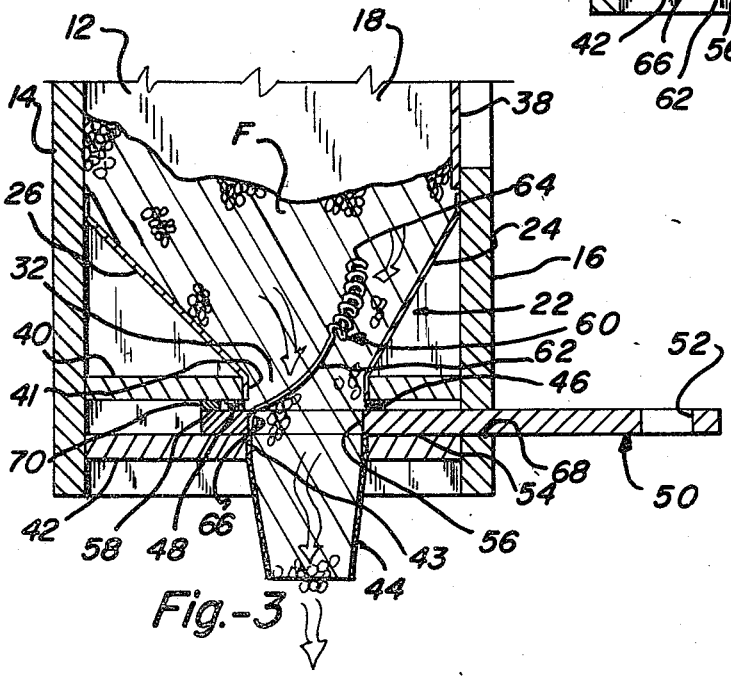
FIG. 3 is a cross-sectional view similar to FIG. 2 but showing the sliding gate in open position.
Figure 4:
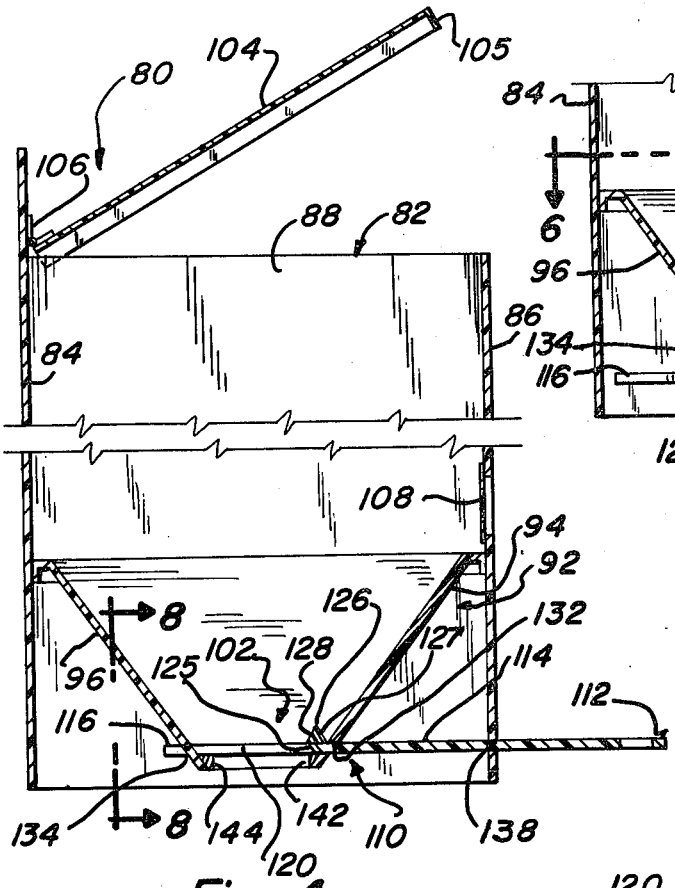
FIG. 4 is a cross-sectional view of a preferred embodiment of the dog food dispenser showing the sliding gate in open position.

Also as best seen in FIGS. 2 and 3, the gate 50 is slidably received and retained in the space between upper plate 40 and lower plate 32. A slot 68 is provided in the front panel 16 to accommodate forward extension of the handle portion 52 of gate 50 through the frontal exterior of the dog food dispenser 10 for convenient manual operation.

As best seen in FIG. 2, when the gate 50 is slidably moved rearwardly, the solid center section 54 effectively blocks the outlet hole 32 in hopper 22, thereby precluding the flow of dog food F from the bin 12. Alternatively, as best seen in FIG. 3, when the gate 50 is slidably moved forward until the opening 56 therein is aligned with the outlet hole 32, dog food F can flow downwardly out of the bin 12. Of course, the gate 50 could be set at any position between the extremes of fully closed and fully opened to regulate the rate of flow of dog food F from the bin 12.

Common dog food products are processed and packaged in the form of pellets or granular particles which may have a tendency to bridge and thereby block downward flow of the dog food F in the lower portion of the hopper 22 as the pellets or granular particles converge toward the outlet opening 32. To alleviate this problem, agitator means is provided in the vicinity of the opening 32 to stir and break down the bridging of the dog food F to enhance and encourage flow of the dog food out of the outlet opening 32. As best seen in FIGS. 2 and 3, the dog food dispenser 10 of the present invention is provided with an agitator 60 comprised of a resilient rod 62 attached at one end by screw 66 to the rearward inside peripheral surface of the opening 56 in gate 50. Its distal end is biased to extend upwardly in the outlet hole 32 and terminates in a coiled spring configuration 64.

As illustrated in FIG. 2, when the gate 50 is slidably moved into closed position, the rod 62 of agitator 60 is drawn rearwardly by gate 50 and is simultaneously cammed downwardly by the lower edge of rear wall 26 of hopper 22. This movement draws the coiled spring portion 64 in a raking movement downwardly and rearwardly through the dog food in the vicinity of the outlet opening 32. Alternatively, when the gate 50 is slidably moved forward to the open position, as shown in FIG. 3, the rod 62 springs upwardly causing the coiled spring portion 64 to move in a raking motion forwardly and upwardly through the dog food F in the vicinity of the outlet opening 32. Consequently, the operation of manually opening and closing the gate 50 to regulate the flow of dog food from the bin 12 simultaneously operates to agitate the dog food in the vicinity of the outlet opening 32 to encourage continued flow of the dog food out of the bin 12.

The sliding movement of the gate 50 has a tendency to carry particles of dog food which may be lying on the upper surface thereof into the guide space between upper plate 40 and lower plate 42. Eventually this tendency could result in a build-up of dog food in the guide space sufficient to interfere with the proper sliding movement of the gate 50. To alleviate this problem, wipers 46, 48 are provided around the peripheral surface of the outlet hole 32 to prevent dog food from being carried by the gate 50 into the space between upper plate 40 and lower plate 42. These wipers 46, 48 are preferably in the form of stiff bristle brushes or resilient rubber blades.

A guide shoulder 70 is also provided on the upper surface of the end section 58 of gate 50 both to provide stability to the gate 50 by maintaining the distance between end section 58 and upper plate 40 and to function as a limit stop to limit the forward travel of gate 50 to the full open position by abutting against wiper 48, as illustrated in FIG. 3. This limit stop prevents the operator from sliding the gate 50 too far forward where it could be derailed by allowing the end section 58 to enter the vicinity of the outlet hole 32.

Additional conveniences include a transparent sight glass 38 in the front panel 16 so the user can monitor the contents of dog food remaining in the bin, and a chute 44 attached by screws 45 to the inside peripheral surface of the hole 43 in lower plate 42 to confine the flow of dog food from the bin to a manageable stream into a container or bowl B.

From the foregoing description of one embodiment, it can be appreciated that the dog food dispenser is best adapted for use by suspending it or hanging it on a wall.

Bulk dog food purchased in a sack can then be poured into the bin 12 for storage, as indicated by an arrow designated 72, by opening cover 34. The dog food can then be dispensed in smaller desired portions into a feeding bowl B as desired by simply operating the sliding gate 50. Consequently, the bags of dog food need only be handled infrequently when it is necessary to refill the bin 12, and the remainder of the time a pet owner can feed his dog conveniently, neatly, and with relative ease by dispensing the required portions of dog food F with this invention.

A preferred embodiment of the dog food dispenser of this invention is illustrated in FIGS. 4 through 9. The dog food dispenser 80 of this embodiment is similarly comprised of a bin 82 enclosed by a back panel 84, front panel 86, and side panels 88, 90, and is provided with a hopper bottom 92 and cover 104. The hopper bottom 92 is comprised of an inverted, truncated, pyramid-shaped section at the bottom of bin 82 having a back wall 96, front wall 94, and lateral walls, 98, 100, each rigidly attached to rear panel 84, front panel 86, side panels 88, 90, respectively, and converging downwardly and inwardly toward an outlet hole 102.

Figure 7:
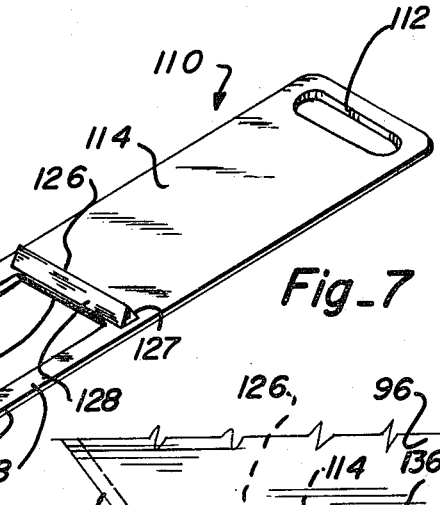
FIG. 7 is an isometric view of the sliding gate isolated from the remainder of the dispenser.

The gate, guide means, and agitator means in this embodiment are somewhat less complex in form than those in the embodiment described above and are not so conducive to jamming by build-up of dog food in the guide means. As best seen in FIG. 7, the sliding gate 110 of this embodiment is comprised of a handle section 112 at the forward end, a solid center section 114, and an opening 120 at the rearward end between two rearwardly extending guide fingers 116, 118. The opening 120 in this embodiment is merely a wide, open-ended slot extending inwardly from the rear end of the gate 110 between the guide fingers 116, 118 to the solid center section 114.

A wide slot 132 is provided in front wall 94 near its bottom to slidably receive and support the center section 114 of gate 110, and two spaced-apart narrow slots 134, 136 are provided near the bottom of rear wall 96 to slidably receive and support guide fingers 116, 118, respectively.

Figure 6:
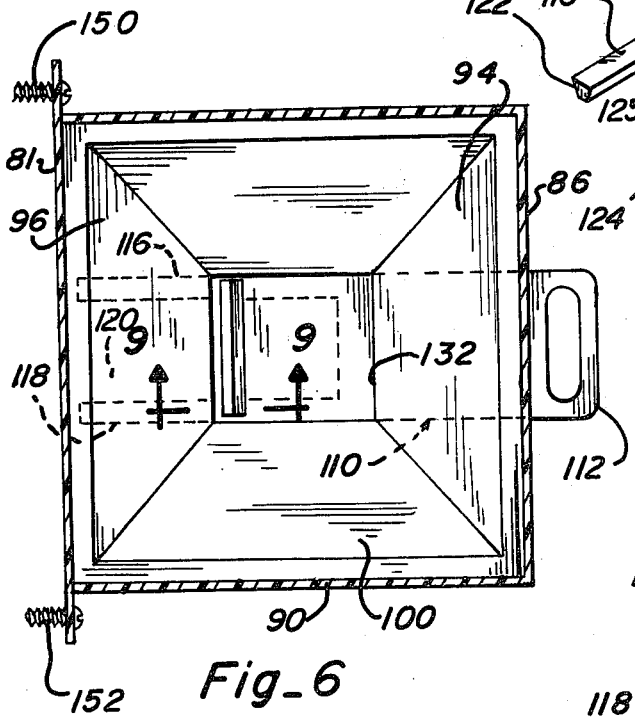
FIG. 6 is a sectional view taken along lines 6—6 of FIG. 5 to illustrate the inside of the hopper bottom.
Figure 8:
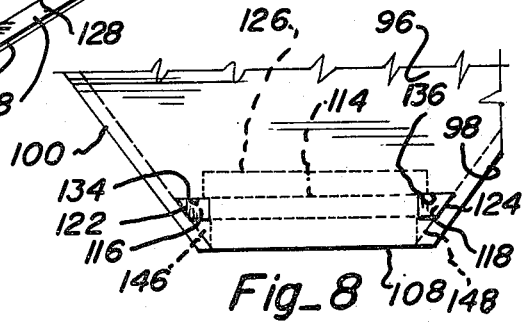
FIG. 8 is a sectional view taken along lines 8—8 of FIG. 4 showing the rear side of the hopper bottom and the guide fingers of the sliding gate protruding therethrough.

As best seen in FIGS. 6 through 8, the gate 110 is sized and proportioned to slidably but snugly fit between lateral walls 98, 100 of hopper 92 where it is positioned in the outlet hole 102. The lateral edges 122, 124 of gate 110 are beveled at an angle corresponding with the angle of slant of the lateral walls 98, 100 to provide a more effective seal against dog food escaping between the lateral edges 122, 124, and lateral walls 98, 100. The rearward edge 125 of the solid center section 114 is also beveled on an angle corresponding to the angle of slant of the rear wall 96 to form a more effective seal therebetween when the gate 110 is in the full closed position. This beveled edge 125 also reduces the resistance to the gate 110 sliding rearwardly through the dog food toward the closed position. A slot 138 is also provided in the lower portion of front wall 86 to accommodate extension of the handle portion 112 out the front of the dog food dispenser 80 for convenient manual operation thereof.

Figure 5:
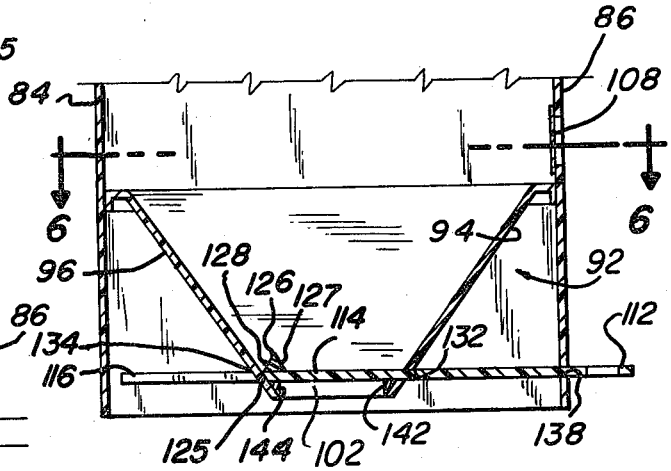
FIG. 5 is a cross-sectional view similar to FIG. 4 but showing the sliding gate in closed position.
Figure 9:
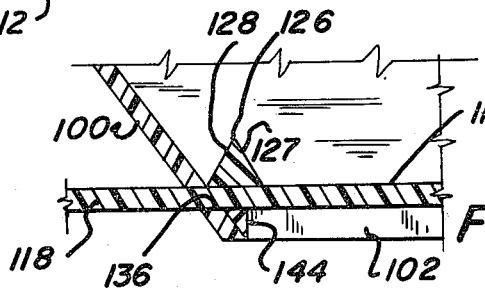
FIG. 9 is a sectional view taken along lines 9—9 of FIG. 6 and showing a portion of the sliding gate in closed position.

As best seen in FIGS. 5, 6 and 9, when the gate 112 is properly positioned in the guide slots 132, 134, 136 and 138, and is slidably moved rearward, the solid center section 114 effectively blocks the outlet hole 102, thereby precluding dog food from flowing out of the bin 82. Alternatively, when the gate 110 is slidably moved forward, the opening 120 becomes aligned with the outlet hole 102 thereby allowing dog food to flow downwardly out of the bin 82 between guide fingers 116, 118, and through outlet hole 102. Since the guide slots 132, 134 and 136 are closely sized and proportioned to slidably but snugly fit the solid center section 114 and the guide fingers 116, 118, respectively, particles of dog food laying on the upper surface of the gate 110 are wiped off as the gate 110 is slidably moved and are precluded from either interfering with the sliding movement of the gate 110 or from excessive spilling through the guide slots. Guide runners 142, 144, 146 and 148 are rigidly attached on the bottom edges of hopper walls 94, 96, 100 and 98, respectively, both to reinforce the lower portions of the hopper walls and to provide larger guide surfaces for slidably supporting the gate 110.

An agitator 126 in the form of a transverse rib of generally triangular cross-section rigidly attached to and extending upwardly from the upper surface of solid center section 114 adjacent the opening 120 is also provided on the gate 110. As best seen in FIGS. 4, 5, 6 and 9, the agitator 126 has oppositely inclined front and rear surfaces 127 and 128 tapering or converging upwardly from the upper surface of gate 110 into the outlet opening 102 and is operative to rake through and to loosen the dog food in the immediate vicinity of outlet opening 102 as the gate 110 is slidably moved forwardly and rearwardly to its open and closed positions. This raking motion of the agitator 126 is effective to break down bridging or jamming of pellets or granular particles of dog food which results from the dog food converging toward the outlet hole 102 and thereby encourages flow of the dog food out the outlet opening 102 when the gate 110 is in open position. Since particles of dog food directly in the path of movement of the agitator tend to glide over the inclined surfaces 127, 128, the agitator 126 can rake through the dog food with reduced resistance to its movement and less tendency to jam dog food in its path while still performing its function of agitating the dog food in the vicinity of the outlet opening 102.

The agitator 126 also serves as a limit stop for gate 110 by abutting against rear wall 96 when the gate 110 is in full closed position and by abutting against front wall 94 when the gate 110 is in full closed position. Since the agitator 126 is positioned on the solid center section 114 in transverse orientation adjacent the opening 120, as described above, and it is long enough to span the width of opening 120, as illustrated in FIGS. 6 and 7, it is operative to shove particles of dog food in the immediate vicinity of the gate 110 into the opening 120 as the gate 110 is being closed and the agitator is being simultaneously moved into abutment against rear wall 96.

The cover 104 of the dog food dispenser 80 of this embodiment is pivotally mounted to the back panel 84 by hinge 106 and includes a downwardly extending lip 105 to enclose the upper ends of front panel 86 and side panels 88, 90 when in closed position. The back panel 84 extends beyond side panels 88, 90, and the dog food dispenser can be conveniently attached to a wall by screws 150, 152 as shown in FIG. 6. This embodiment is also provided with a transparent sight glass 108 in front panel 86 to enable the user to visually observe and monitor the remaining contents of unused dog food in the bin 82.

Although the present invention has been described with a certain degree of particularity, it is understood that the present disclosure has been made by way of example, and that changes in details and structure may be made without departing from the spirit thereof.

What is claimed is:

1. In apparatus for storing and dispensing dry pellet-like food particles in which a storage bin has a hopper bottom with an outlet hole at its lower extremity for allowing food particles to flow out of said bin, the improvement comprising:

a slidable gate traversing said outlet hole in said hopper bottom for regulating the flow of food particles out of the bin, said gate having an elongated generally rectangular body and provided with a handle at one end, a solid center section, and an opening at its opposite end such that sliding said gate longitudinally in one direction results in aligning said solid center section with said outlet hole for effectively closing said outlet hole to preclude flow of food particles from said bin and sliding said gate longitudinally in the opposite direction results in aligning said opening with said outlet hole to allow food particles to flow out of the bin;

an upper plate sealed against and extending both in one direction from said outlet hole and in the opposite direction from said outlet hole, said upper plate having a hole therein concentric with said outlet hole to allow food particles to flow therethrough, a lower plate in parallel spaced-apart relation to said upper plate, said lower plate also having a hole therethrough axially aligned with said outlet hole, wiper means extending downwardly from said upper plate adjacent said hole in said upper plate for wiping any food particles on the upper surface of said gate into said opening as said gate is slidably moved open or closed thereby preventing build-up of food particles between said gate and said upper plate which could otherwise inhibit free movement of said gate; and agitator means on said sliding gate extending upwardly through said outlet hole into said bin for agitating the food particles in the immediate vicinity of said opening as said gate is slidably moved in either direction to encourage removal of the food particles from said bin as said gate is advanced to align said opening with said hole.

2. In the apparatus of claim 1, wherein a flexible chute is attached to the inside peripheral surface of said hole in said lower plate to confine and direct the downward flow of food particles into a receptacle when said gate is opened, and said gate includes a stabilizing guide shoulder extending upwardly from said opposite end of said gate into sliding contact with said upper plate for maintaining said gate in non-binding longitudinal alignment with said upper and lower plates and for limiting the travel of said gate by abutting against said wiper means when said opening in said gate is axially aligned with said outlet opening.

3. In the apparatus of claim 2, wherein said agitator means includes a resilient rod attached at one end to the inside surface of said opening in said gate, said rod being biased in an upwardly directed curve through said outlet hole and having a coiled portion at its distal end, said resilient rod being positioned such that it is cammed downwardly by the edge of said hole in said upper plate as said gate is slidably moved to its closed position and such that it protrudes upwardly through said outlet hole into said bin when said gate is opened.

4. In apparatus for storing and dispensing dry pellet-like food particles in which a storage bin has a hopper bottom with an outlet hole at its lower extremity for allowing food particles to flow out of said bin, the improvement comprising:

a slot in one wall of said hopper and at least one other slot in the diametrically opposite wall of said hopper;

a gate having a solid enlarged portion and at least one guide finger portion extending longitudinally from said enlarged portion, said gate being slidably positioned in said slots and traversing said outlet hole, said solid enlarged portion being slidably positioned in said slot in said one wall and said guide finger portion being slidably positioned in said other slot in said diametrically opposite wall, said enlarged portion being of a width approximately equal to the width of said hopper at the section of said hopper through which said gate traverses said hopper such that said enlarged portion is effective to seal against food particles flowing downwardly in said hopper when said enlarged portion is traversing said outlet hole, and said guide finger being relatively narrow in relation to said enlarged portion such that food particles can flow past said guide finger when said guide finger is traversing said outlet hole.

5. In the apparatus of claim 4, wherein said slot in the diametrically opposite wall of said hopper is sized and shaped corresponding to the size and shape of said finger such that said finger is readily slidable in said slot in said opposite wall, and said slot in said one wall is sized and shaped to correspond to the size and shape of said enlarged portion of said gate such that said enlarged portion is readily slidable in said slot in said one wall to accommodate longitudinal movement of said gate while precluding dog food from spilling from said bin through said slots.

6. In apparatus for storing and dispensing dry pellet-like food particles in which a storage bin has an outlet hole at its lower extremity for allowing food particles to flow out of said bin, the improvement comprising:

a slot in one wall of said bin, and two slots in spaced-apart relation to each other in the wall of said bin that is diametrically opposite said one wall, an elongated, generally rectangular gate slidably positioned in said slots and traversing the interior of said bin over said outlet hole, said gate having a handle at one end external of said bin, a solid center section of a width approximately equal to the width of said bin at the section of said bin through which said gate traverses said bin such that the lateral edges of said gate at said center section are in slidable contact with said lateral walls of said bin to seal against food particles flowing downwardly in said bin between said lateral edges of said gate and the lateral walls of said bin, and two relatively narrow fingers extending longitudinally outward in said opposite direction from said solid center section in parallel, spaced-apart relation to each other, the space between said fingers forming an opening in said gate, said center section being slidably positioned in said slot in said one wall and said fingers being slidably received and supported in said slots in said diametrically opposite wall of said bin.

7. In the apparatus of claim 6, wherein the walls of said bin are slanted to converge downwardly and inwardly to said outlet hole, the outside edges of said slots are flush with the inside surfaces of said lateral walls and the outside lateral edges of said gate are beveled at an angle corresponding to the slant of said lateral walls to achieve a wider and more effective seal between said gate and said lateral walls, said slot in said one wall is sized and shaped corresponding to the size and shape of said center section of said gate, said two slots in said diametrically opposite wall being of sizes and shapes corresponding to respective of said fingers, and the distance between said slots in said opposite wall correspond to the distance between said fingers.

8. In the apparatus of claim 7, including a traverse rib protruding upwardly from the top surface of said gate from a location near the place where said fingers meet said solid center section, said rib being operative both to agitate food particles in the vicinity of said gate as said gate is slidably moved and to limit the travel of said gate by abutting against said one wall when said gate is moved to its fully open position and by abutting against said diametrically opposite wall when said gate is moved to its full closed position.

9. In the apparatus of claim 8, including guide runners rigidly attached to the inside walls of said hopper with the upper surfaces of said runners being flush with the bottom surface of said slots.

10. An apparatus for storing and dispensing granular material, comprising:

a storage bin having a hopper bottom with an outlet hole at the lower extremity thereof, said hopper bottom having a larger slotted guide hole in its front wall and at least one smaller slotted guide hole in its rear wall;

a gate in said hopper bottom across said outlet hole, said gate having a solid center section positioned in and slidably supported by said larger slotted hole, at least one guide finger extending rearwardly from said solid center section positioned in and slidably supported by said smaller slotted hole, and a handle portion extending forward from said solid center section for manipulation of said gate whereby slidably moving said gate rearwardly aligns said solid center section across said outlet hole to inhibit material from flowing out of said bin and slidably moving said gate forwardly aligns said finger across said outlet hole thus allowing material to freely flow downwardly past said finger and out of said bin.

11. The apparatus of claim 10, wherein said hopper bottom is substantially in the form of an inverted truncated pyramid comprised of a front wall, a rear wall, and two diametrically opposed lateral walls all converging downwardly and inwardly to a central outlet hole and said solid center section of said gate is sized and proportioned to completely span the distance between said lateral walls in its closed position to effectively block any material from escaping between said lateral walls and the lateral edges of said gate.

12. The apparatus of claim 11, wherein the outside edges of said larger slotted guide hole are flush with the respective inside surfaces of said lateral walls and the lateral edges of said solid central section of said gate are beveled at an angle corresponding to the angle of slant of said lateral walls to provide a more effective slidable seal between said lateral walls and said gate.

13. The apparatus of claim 12, including two smaller slotted guide holes in said rear wall horizontally aligned with said larger slotted guide hole in said front wall and spaced apart from each other, the outside edge of each of said smaller guide holes being flush with the inside surface of each respective lateral wall, and including two spaced-apart guide fingers extending rearwardly from said solid central section, the space between said fingers forming an opening extending forward from the rear extremities of said fingers to said solid center section, the outside lateral edges of said fingers being beveled and in longitudinal alignment with respective lateral edges of said solid center section, whereby slidably moving said gate rearwardly results in said solid center section becoming aligned with said outlet hole effectively blocking any flow of material out of said bin and slidably moving said gate forwardly results in said opening between said fingers becoming aligned with said outlet hole allowing material to flow out of said bin.

14. The apparatus of claim 13, including agitator means attached to and extending upwardly from said gate into said bin for agitating the material in said bin in the vicinity of said outlet hole to break down bridging of particles of the material and encourage the material to flow out of said bin as said gate is slidably moved.

15. The apparatus of claim 14, wherein said agitator means is comprised of a transverse rib protruding upwardly from the upper surface of said gate into said bin.

16. The apparatus of claim 15, wherein said rib has oppositely inclined front and rear surfaces converging upwardly and toward each other to encourage particles of material to glide smoothly over said rib as it is moved therethrough.

17. The apparatus of claim 16, wherein said rib is also a limit stop positioned on said solid center section immediately adjacent said opening for limiting both the forward and rearward travel of said gate by abutting against said front wall when said gate is moved to its full open position and by abutting against said rear wall when said gate is moved to its full closed position.

* * * * *